United States Patent [19]

Howell et al.

[11] Patent Number: 5,050,654

[45] Date of Patent: Sep. 24, 1991

[54] UMBRELLA TABLE COVER

[76] Inventors: James K. Howell; Rae E. Howell, both of 3410 Wild Oak Bay Blvd., #110, both of Bradenton, Fla. 34210

[21] Appl. No.: 554,174

[22] Filed: Jul. 16, 1990

Related U.S. Application Data

[63] Continuation of Ser. No. 125,208, Nov. 25, 1987, abandoned.

[51] Int. Cl.[5] ..... B65D 65/02

[52] U.S. Cl. ..... 150/158; 47/41.01; 47/41.12

[58] Field of Search ..... D6/617, 621; 150/52 R, 150/158, 900; 135/98, 99, 116, 120; 47/66, 39, 41 R, 71, 82, 83, 48.5, 41.12, 41.01

[56] References Cited

U.S. PATENT DOCUMENTS

| | | | |
|---|---|---|---|
| 2,188,488 | 1/1940 | Talmadge | 150/52 R |
| 2,486,320 | 10/1949 | Ost | 150/52 R |
| 2,812,900 | 11/1957 | Mathews | 150/52 R |
| 2,904,933 | 9/1959 | King | 47/41.12 |
| 2,922,254 | 1/1960 | Smithers | 47/41.12 |
| 2,981,033 | 4/1961 | Cheetwood | 47/41.12 |
| 3,116,774 | 1/1964 | Callahan | 150/52 R |
| 3,378,710 | 10/1966 | Kesh | 150/52 R |
| 3,651,601 | 3/1972 | LaMontagne | 47/41.12 |
| 3,782,435 | 1/1974 | Sherman | 150/52 R |
| 4,238,374 | 12/1980 | Durham et al. | 47/41.12 X |
| 4,445,298 | 5/1984 | Roder | 47/41.12 |
| 4,597,221 | 7/1986 | Adair et al. | 47/66 |

*Primary Examiner*—Robert A. Hafer
*Assistant Examiner*—Kevin G. Rooney
*Attorney, Agent, or Firm*—Charles J. Prescott

[57] ABSTRACT

An umbrella table cover formed generally of a sheet of flexible material sized to usefully cover an umbrella table and including a flexible, expandable, elastic collar secured to the mid-portion of the flexible material. The collar is adapted to receive and elastically bias against the umbrella pole passed therethrough so as to properly orient and retain the table cover atop the umbrella table, prevent debris from dropping through the central aperture in the table, and restrict billowing of the table cover in a breeze. The collar may include additional flexible material which is extendable upwardly along the umbrella pole to decoratively enhance elastically securing the collar around the pole. The collar may also include a close-fitting resilient ring closely yet slideably mating against the umbrella pole. Further, the collar may retain and conceal an annular-shaped container or foam retainer also apertured to receive the umbrella pole passed therethrough, the container for holding water and cut flowers or artificial flowers for decoration.

3 Claims, 1 Drawing Sheet

54
58
62
50
56
T
60
A
P
52

U
P

P
14
10
16
T
A
12
14
2
2
10
12
18
P
T 26
26
24'
26
26'
28
26
24
20
22
P

H
34
30
5
5
32
P
46
40
42
44
38
36
W
T
A 34
44
30
32

UMBRELLA TABLE COVER

This is a continuation of co-pending application Ser. No. 07/125,208, filed on Nov. 25, 1987.

BACKGROUND OF THE INVENTION

This invention relates generally to coverings for table tops, and more particularly to a table cover for an umbrella table.

Applicant is aware of U.S. Pat. No. 3,279,515 to Kesh directed to a table cover including a flexible sheet of material and an elastic element secured around its margin for elastically retaining the table cover atop the table. Additionally, U.S. Pat. No. 3,156,280 to Affholter is directed to a form fitting table cover adapted to overly and be secured onto a rectangular table. Further, applicant is aware of U.S. Pat. No. 2,748,516 directed to a Christmas tree mat having an aperture through the center for receiving the lower trunk of a tree.

Nothing known in prior art, however, is adapted for use in conjunction with an umbrella table having an umbrella pole and umbrella extending through an aperture in the center of the table.

The present invention provides such a table cover in several embodiments which is expandable and elastically biases against the umbrella pole for slideable engagement and installation of the umbrella pole therethrough. Additional structure is provided for enhanced retention and decoration, as well as including an additional concealed container or retainer positionable around the umbrella pole for holding and displaying cut and artificial flowers.

BRIEF SUMMARY OF THE INVENTION

The present invention is directed to an umbrella table cover formed generally of a sheet of flexible material sized to usefully cover an umbrella table and including a flexible, expandable, elastic collar secured to the midportion of the flexible material. The collar is adapted to receive and elastically bias against the umbrella pole passed therethrough so as to properly orient and retain the table cover atop the umbrella table, prevent debris from dropping through the central aperture in the table, and restrict billowing of the table cover in a breeze. The collar may include additional flexible material which is extendable upwardly along the umbrella pole to decoratively enhance elastically securing the collar around the pole. The collar may also include a close-fitting resilient ring closely yet slideably mating against the umbrella pole. Further, the collar may retain and conceal an annular-shaped container or foam retainer also apertured to receive the umbrella pole passed therethrough, the container or retainer for holding water and cut flowers or artificial flowers, respectively, for decoration.

It is therefore an object of this invention to provide a table cover for umbrella tables which is mateable atop these tables and adapted to snuggly receive the umbrella pole and retain the invention in proper position atop the umbrella table.

It is another object of this invention to provide an umbrella table cover disposable atop an umbrella table providing decorative mateable interengagement with the umbrella pole when the attached collar of the invention is in alignment and registry with the aperture in the table top of the umbrella table.

It is yet another object to provide the above invention to include a concealed annular-shaped container or foam retainer positionable in conjunction with its flexible collar for retaining and displaying cut or artificial flowers on an umbrella table around and immobilized by its umbrella pole.

In accordance with these and other objects which will become apparent hereinafter, the instant invention will now be described with reference to the accompanying drawings in which:

DETAILED DESCRIPTION OF THE INVENTION

Figures 1, 2, 3, 4, 5, 6:
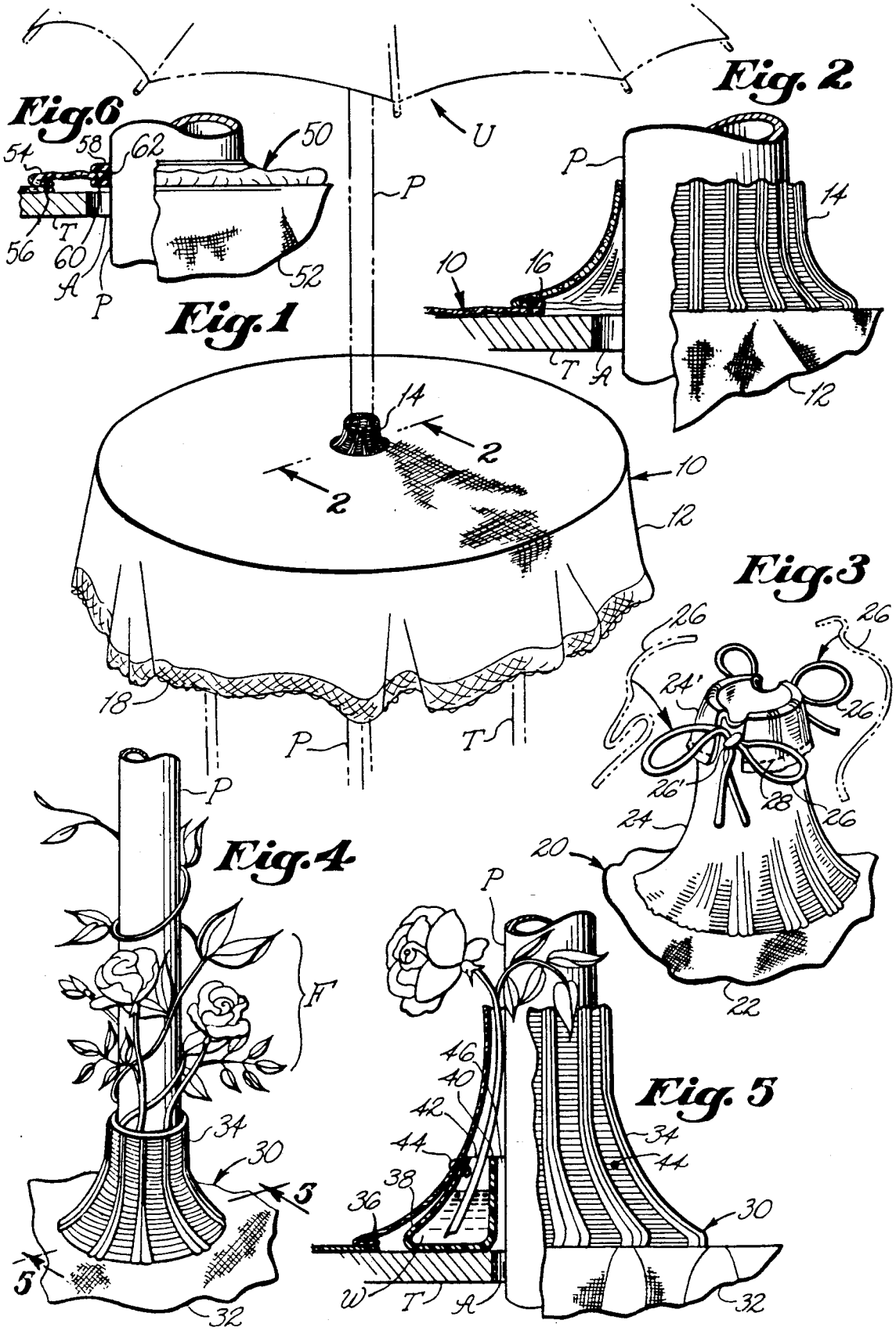
FIG. 1 is a perspective view of the preferred embodiment of the invention in use atop an umbrella table.
FIG. 2 is an enlarged partial section view in the direction of arrows 2—2 in FIG. 1.
FIG. 3 is an enlarged perspective view of another embodiment of the centrally located elastic collar of the invention.
FIG. 4 is an enlarged perspective view of yet another embodiment of the centrally located elastic collar of the invention.
FIG. 5 is an enlarged partial section view in the direction of arrows 5—5 in FIG. 4.
FIG. 6 is an enlarged partial section view similar to FIG. 2 with respect to yet another embodiment of the centrally located elastic collar of the invention.

Referring now to the drawings, and particularly to FIGS. 1 and 2, the preferred embodiment of the invention is shown generally at 10 and includes a table cover 12 formed of flexible sheet material having a margin 18 which preferably hangs over and beyond the edge of the table T of umbrella table U. Disposed centrally in sheet 12 is collar 14 which is sewn along 16 to connect the collar 14 to sheet 12 as shown. Collar 14 is fabricated of flexible, expandable, elastic material such that, when umbrella pole P is passed through the aperture A in table T, and when collar 14 is aligned and in registry with aperture A, collar 14 elastically stretches and is biased against umbrella pole P as shown. The preferred material is a synthetic ribbed knit fabric.

By this arrangement, then, collar 14 is expandable to elastically bias against umbrella pole P to prevent debris from falling through aperture A and also for centering table cover 10 over the table T so that margin 18 hangs evenly from the margin of the table T. Additionally, because collar 14 is biased against umbrella pole P, the table cover 10 resists billowing at its center portion and being displaced from the table T in a breeze. Further, because collar 14 is fabricated of additional flexible material as shown, it may be upwardly extended on pole P to enhance the decorative aspects of table cover 10.

Referring now to FIG. 3, an alternate embodiment of the invention is shown generally at 20 and includes flexible sheet 22 which rests atop the table T. In this embodiment 20, collar 24, also fabricated of elastic, expandable material as previously described, also includes hem 24' which folds back against the main upper portion of collar 24 and is held in this doubled over configuration by stitching along 28. Tie strings 26 are also provided in this embodiment 20 which are fitted within the passageway formed by hem 24' such that they may be drawn securely together and tied in a bow 26' to provide additional biasing against the umbrella pole P (not shown) to further restrict vertical displacement of the collar 24 along the umbrella pole P and to add additional decoration.

Referring now to FIGS. 4 and 5, another embodiment of the invention is shown generally at 30 and is structured similar to that described with respect to FIG. 1. This embodiment includes flexible sheet 32 having collar 34 disposed and connected by stitching as described with respect to FIG. 1. Collar 34 is also elastic and upwardly extending along umbrella pole P as shown.

This embodiment also includes container 38 which is structured as seen in FIG. 5 to be generally annular-shaped having aperture 46 centrally disposed to receive umbrella pole P. Container 38, generally u-shaped in cross section as shown, is formed by its upper margin 40 so as to receive and contain water W therein and to receive the stems of cut flowers F passed into opening 42 as shown.

Container 38 is, preferably attached to collar 34 by rivets 44 so that the entire assembly 30, including container 38 and collar 34, may be easily and conveniently placed atop the table T and properly aligned with aperture A in the table T.

Container 38 is, by this arrangement, concealed from view, yet nurtures the cut flowers F by water W contained therein. Collar 34 elastically biases the stems of flowers F, against the umbrella pole P retaining them so that their stems remain in water W. The elasticity of the extended collar 34 further facilitates retention and easy arrangement of the cut flowers F as desired for decoration.

Shaped generally similar to container 38, an alternate embodiment may be provided therefor, fabricated of either rigid STYROFOAM (expanded synthetic resinous material) or nursery foam. The STYROFOAM embodiment is provided for use in conjunction with receiving and supporting stems of artificial flowers, while the nursery foam embodiment designed to absorb and retain water may be used in conjunction with freshly cut flowers.

Referring lastly to FIG. 6, another embodiment of the invention is shown generally at 50 and includes flexible sheet 52 having elastic collar 54 attached thereto by sewing along 56 as previously described. However, in this embodiment, a resilient ring 58 is connected to the inner margin of flexible collar 54 by stitching along 60. This ring 58 is fabricated, preferably of resilient yet relatively hard rubber material having aperture 62 adapted to snuggly, yet slideably mate along umbrella pole P. This arrangement of ring 58 and flexible collar 54 connected to sheets 52 is adapted, when umbrella pole P passes through aperture 62 and the aperture A in table T, to resist virtually all upward or downward movement of both ring 58 and the center portion of the table cover 50 due to breezes, winds, jostling and the like.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. An umbrella table cover for an umbrella table having an umbrella pole aperture disposed generally through a central portion of the table, the aperture for slidably receiving and supporting an upright umbrella pole, said table cover comprising:

a flexible flat sheet structured to freely lay atop and to cover the table, said flat sheet extending beyond and freely hanging downward from all edges of the table;

said flat sheet having a continuous upstanding, elastic collar connected to, and upwardly extending from, a mid point of said flat sheet;

said elastic collar aligning with the umbrella pole aperture and sized to snuggly receive and extend upwardly from the table around the umbrella pole when the umbrella pole is passed through said elastic collar;

said elastic collar elastically squeezing against the umbrella pole to resist upward movement of the central portion of said table cover when blown by a breeze;

said table cover further comprising an annular-shaped container structured to be supported atop the table surrounding the umbrella pole aperture and to receive the umbrella pole passed therethrough;

said container sized to fit beneath and be at least partially concealed by said elastic collar;

said container at least partially open along its upper margin to receive liquid and the stems of cut flowers placed therein for displaying the flowers upwardly extending from said elastic collar and against the umbrella pole.

2. An umbrella table cover for an umbrella table having an umbrella pole aperture disposed generally through a central portion of the table, the aperture for slidably receiving and supporting an upright umbrella pole, said table cover comprising:

a flexible flat sheet structured to freely lay atop and to cover the table, said flat sheet extending beyond and freely hanging downward from all edges of the table;

said flat sheet having a continuous upstanding, elastic collar connected to, and upwardly extending from, a mid point of said flat sheet;

said elastic collar aligning with the umbrella pole aperture and sized to snuggly receive and extend upwardly from the table around the umbrella pole when the umbrella pole is passed through said elastic collar;

said elastic collar elastically squeezing against the umbrella pole to resist upward movement of the central portion of said table cover when blown by a breeze;

said table cover further comprising an annular-shaped retainer structured to be supported atop the table surrounding the umbrella pole aperture and to receive the umbrella pole passed therethrough;

said retainer fabricated of rigid expanded synthetic resinous material and sized to fit beneath and be at least partially concealed by said elastic collar;

said retainer structured to receive the stems of artificial flowers inserted therein for displaying the flowers upwardly extending from said elastic collar and against the umbrella pole.

3. An umbrella table cover for an umbrella table having an umbrella pole aperture disposed generally through a central portion of the table, the aperture for slidably receiving and supporting an upright umbrella pole, said table cover comprising:

a flexible flat sheet structured to freely lay atop and to cover the table, said flat sheet extending beyond and freely hanging downward from all edges of the table;

said flat sheet having a continuous upstanding, elastic collar connected to, and upwardly extending from, a mid point of said flat sheet;

said elastic collar aligning with the umbrella pole aperture and sized to snuggly receive and extend upwardly from the table around the umbrella pole when the umbrella pole is passed through said elastic collar;

said elastic collar elastically squeezing against the umbrella pole to resist upward movement of the central portion of said table cover when blown by a breeze;

said table cover further comprising an annular-shaped retainer structured to be supported atop the table surrounding the umbrella pole aperture and to receive the umbrella pole passed therethrough;

said retainer fabricated of nursery foam and sized to fit beneath and be at least partially concealed by said elastic collar;

said retainer structured to receive the stems of fresh cut flowers inserted therein for displaying the flowers upwardly extending from said elastic collar and against the umbrella pole.

* * * * *